US007611451B2

(12) United States Patent
Gwin et al.

(10) Patent No.: US 7,611,451 B2
(45) Date of Patent: Nov. 3, 2009

(54) CENTRIFUGE ASSEMBLY WITH OPEN-ENDED CANISTER AND CLOSURE CAPS

(75) Inventors: Jared Gwin, Cookeville, TN (US); Hendrik N. Amirkhanian, Cookeville, TN (US); Erica C. Clark, Sparta, TN (US)

(73) Assignee: Cummins Filtration IP Inc., Minneapolis, MN (US)

( * ) Notice: Subject to any disclaimer, the term of this patent is extended or adjusted under 35 U.S.C. 154(b) by 714 days.

(21) Appl. No.: 11/327,565

(22) Filed: Jan. 6, 2006

(65) Prior Publication Data

US 2006/0154798 A1 Jul. 13, 2006

Related U.S. Application Data

(60) Provisional application No. 60/643,066, filed on Jan. 11, 2005.

(51) Int. Cl.
*B04B 7/02* (2006.01)
*B04B 9/06* (2006.01)

(52) U.S. Cl. ..... 494/60; 494/49; 494/64

(58) Field of Classification Search ..... 494/24, 494/36, 43, 49, 64, 65, 67, 83, 84, 901, 5, 494/60; 210/168, 171, 232, 360.1, 380.1, 210/416.5; 184/6.24
See application file for complete search history.

(56) References Cited

U.S. PATENT DOCUMENTS

| | | | | |
|---|---|---|---|---|
| 2,321,144 | A * | 6/1943 | Jones | 494/15 |
| 2,335,420 | A * | 11/1943 | Jones | 184/6.24 |
| 2,723,079 | A * | 11/1955 | More et al. | 494/15 |
| 2,949,045 | A * | 8/1960 | Rushing | 74/609 |
| 6,533,712 | B1 * | 3/2003 | Miller et al. | 494/60 |
| 2002/0119882 | A1 * | 8/2002 | Samways | 494/49 |
| 2006/0154798 | A1 * | 7/2006 | Gwin et al. | 494/49 |

FOREIGN PATENT DOCUMENTS

| | | | |
|---|---|---|---|
| CN | 87104299 | A | 12/1987 |
| CN | 2472816 | Y | 1/2002 |

OTHER PUBLICATIONS

Office Action Issued Jun. 26, 2009 by SIPO in related Chinese Application No. 20061004026.9 - *Translation only provided* -.

* cited by examiner

*Primary Examiner*—Charles E Cooley
(74) *Attorney, Agent, or Firm*—Hamre, Schumann, Mueller & Larson, P.C.; J. Bruce Schelkopf

(57) ABSTRACT

A filtration centrifuge according to a typical embodiment of the present invention includes a housing canister, a rotor assembly, a rotor shaft, a top cap, and a bottom cap. In an alternative embodiment of the present invention, the rotor assembly mounts into the canister without the use of a rotor shaft. The canister is open at both ends and the manner of connection between the top and bottom of the canister and the top and bottom caps includes all possible combinations of internal threads, external threads, and a bayonet connection.

21 Claims, 20 Drawing Sheets

CENTRIFUGE ASSEMBLY WITH OPEN-ENDED CANISTER AND CLOSURE CAPS

CROSS REFERENCE TO RELATED APPLICATIONS

The present application claims the benefit of U.S. Provisional Patent Application Ser. No. 60/643,066, filed Jan. 11, 2005, entitled "Filtration Assembly With Open-Ended Canister" which is hereby incorporated by reference in its entirety.

BACKGROUND OF THE INVENTION

The present invention relates generally to fluid processing centrifuge designs that include a rotor that is positioned inside a housing and constructed for high speed rotation relative to the housing. Various designs are known for the interior configuration of the rotor and various designs are known for the interfaces between the rotor assembly and the housing. A fluid inlet and fluid passageway directed into the rotor assembly delivers the fluid to be processed. A fluid outlet or drain delivers processed fluid to a downstream location. The typical fluid for filtration centrifuges of the type disclosed herein is oil and the centrifuge operates so as to separate out of the oil heavier particulate matter.

More specifically, the present invention relates to a housing or canister design that permits access to the rotor assembly from either the top of the canister or from the bottom of the canister. This means that the rotor assembly and the interior of the canister are serviceable from either or both the top open end of the canister and the bottom open end of the canister. This in turn decreases any serviceability constraints that might otherwise exist in more confined or restricted applications.

There are some applications for a fluid processing (filtration) centrifuge, such as in some buses and trucks, where access to the centrifuge may not be available from the top of the canister. The present invention enables end users and those responsible for servicing of the centrifuge to be able to service the centrifuge from either end direction (top or bottom) depending on the engine platform and any particular needs or constraints.

Other features of the present invention include a novel bottom cap design and provisions for an oil inlet passage through a mounting structure and through a portion of either the bottom cap or top cap used to close off the open ended canister. The design of the bottom cap serves multiple functions, including sealing closed the open end of the canister, providing for an oil inlet path to the interior of the rotor, and provisions for a drain for the processed oil. Removal of the top cap and bottom cap from the canister provides access from either or both ends to the interior of the canister and the rotor assembly. The structure of the present invention is suitable for both engine-mount products/applications and remote-mount products/applications.

SUMMARY OF THE INVENTION

A filtration centrifuge according to a typical embodiment of the present invention includes a housing canister, a rotor assembly, a rotor shaft, a top cap, and a bottom cap. In an alternative embodiment of the present invention, the rotor assembly mounts into the canister without the use of a rotor shaft. The canister is open at both ends and the manner of connection between the top and bottom of the canister and the top and bottom caps includes all possible combinations of internal threads, external threads, and a bayonet connection.

DETAILED DESCRIPTION OF THE INVENTION

Figure 1:
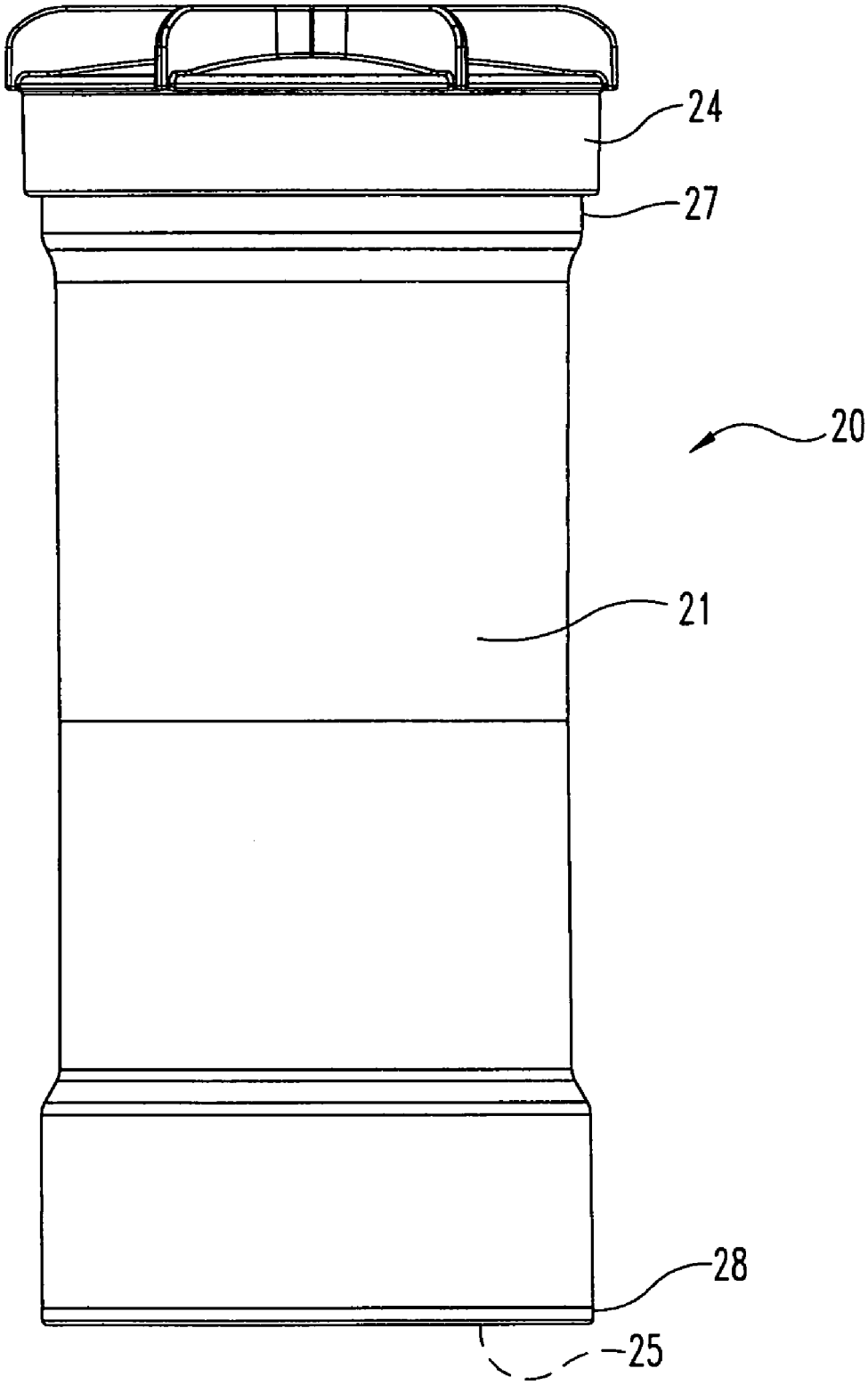
FIG. 1 is a front elevational view of a filtration centrifuge according to one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
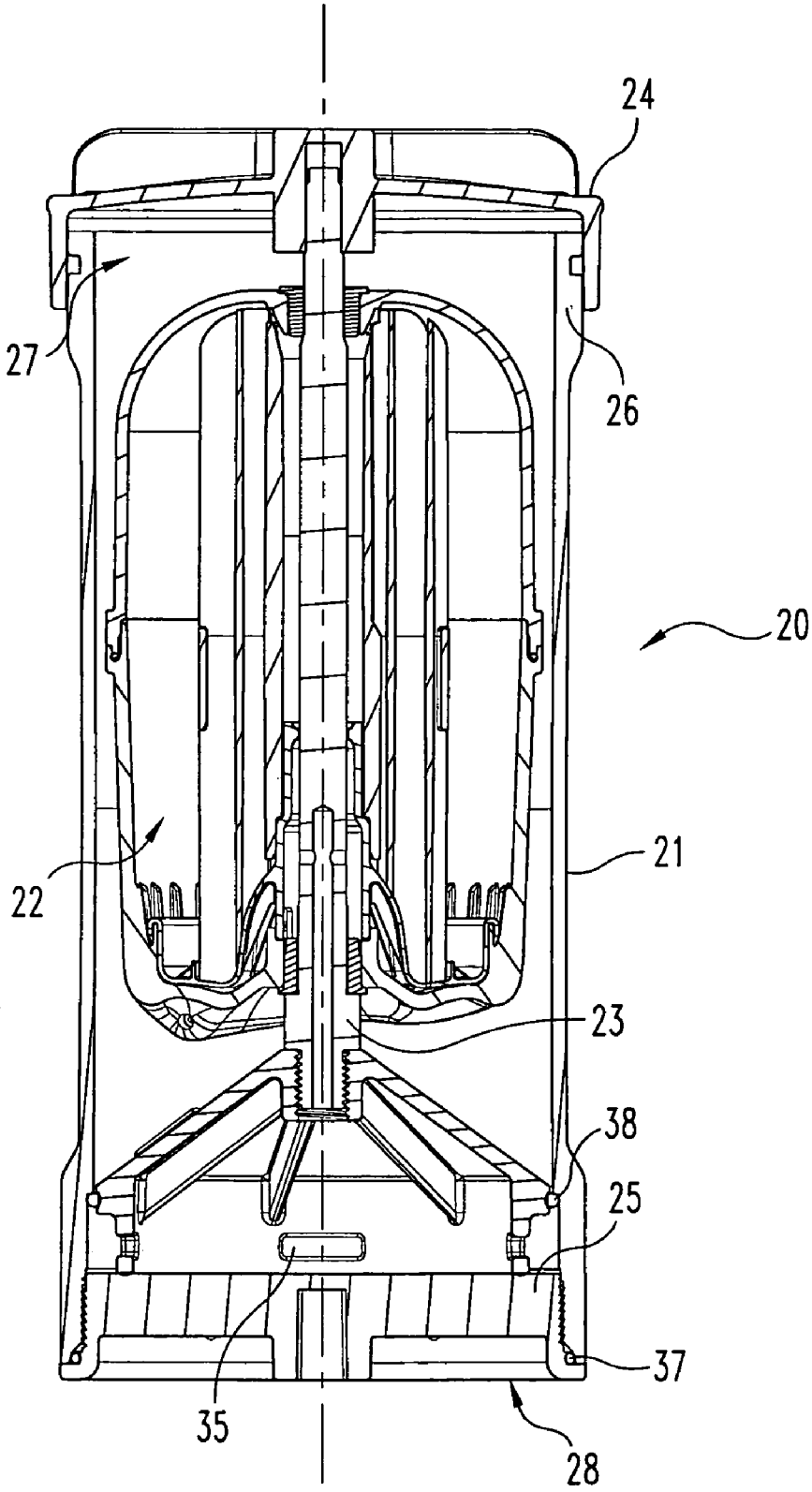
FIG. 2 is a front elevational view, in full section, of the FIG. 1 filtration centrifuge
Figure 3:
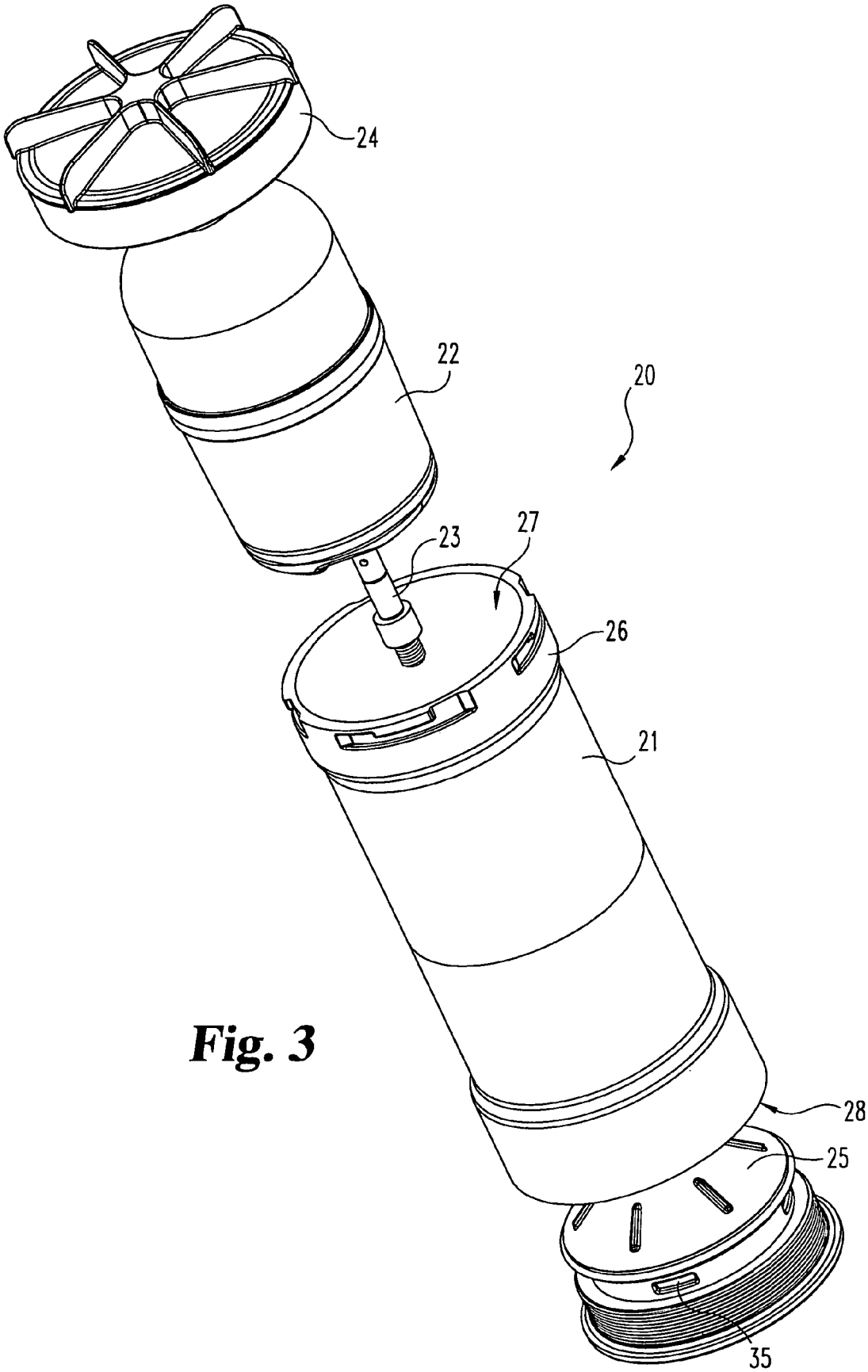
FIG. 3 is an exploded view of the FIG. 1 filtration centrifuge.

Referring to FIGS. 1, 2, and 3, there is illustrated a filtration centrifuge 20 that includes a canister 21, rotor assembly 22, rotor shaft 23, top cap 24, and bottom cap 25. Canister 21 includes a bayonet connection 26 adjacent open end 27 and an internally threaded open lower end 28. As illustrated in FIGS. 11-18, there are eight (8) other alternative canister constructions 21*a*-21*h* that are contemplated and suitable for use as part of filtration centrifuge 20. One assumption that has to be made with regard to these alternative canister constructions is that the styling for the top cap 24 and for the bottom cap 25 are compatible with the particular connection style selected for the corresponding canister. Caps 24 and 25 are also removably assembled to the corresponding end of the canister. When assembled, that end is closed off. When removed, the end is restored to its open condition or status. These other eight alternatives for the canister design include various open end configurations for the connection to the top and bottom caps involving internal threads, external threads, and a bayonet connection. With these three variables, noting that there are two open ends to configure, there are a total of nine (9) different end configurations that are possible, with canister 21 depicting one such combination and canisters 21*a*-21*h* depicting the other eight possible configurations.

Canister 21 a has a "bayonet-external" construction. Canister 21*b* has a "bayonet-bayonet" construction. Canister 21*c* has an "external-bayonet" construction. Canister 21*d* has an "external-external" construction. Canister 21*e* has an "external-internal" construction. Canister 21*f* has an "internal-bayonet" construction. Canister 21*g* has an "internal-internal" construction. Canister 21*h* has an "internal-external" construction. When the housing or canister 21 open end is threaded, the corresponding construction for the matching cap will be to provide corresponding or matching threads so that the connection or assembly of the cap to the canister is by threaded engagement. As for the bayonet connection, this involves axial travel between the cap and the open end. Once properly interfit together, rotation of one component relative to the other, in the correct direction, achieves a secure interlock, as is well-known for "bayonet" connections.

If the particular canister style is labeled or denoted by its upper open end construction first and its lower open end construction second, then canister 21 is described as a "bayonet-internal" canister. This means that the upper open end has a bayonet connection and the lower open end is internally threaded.

Figure 4:
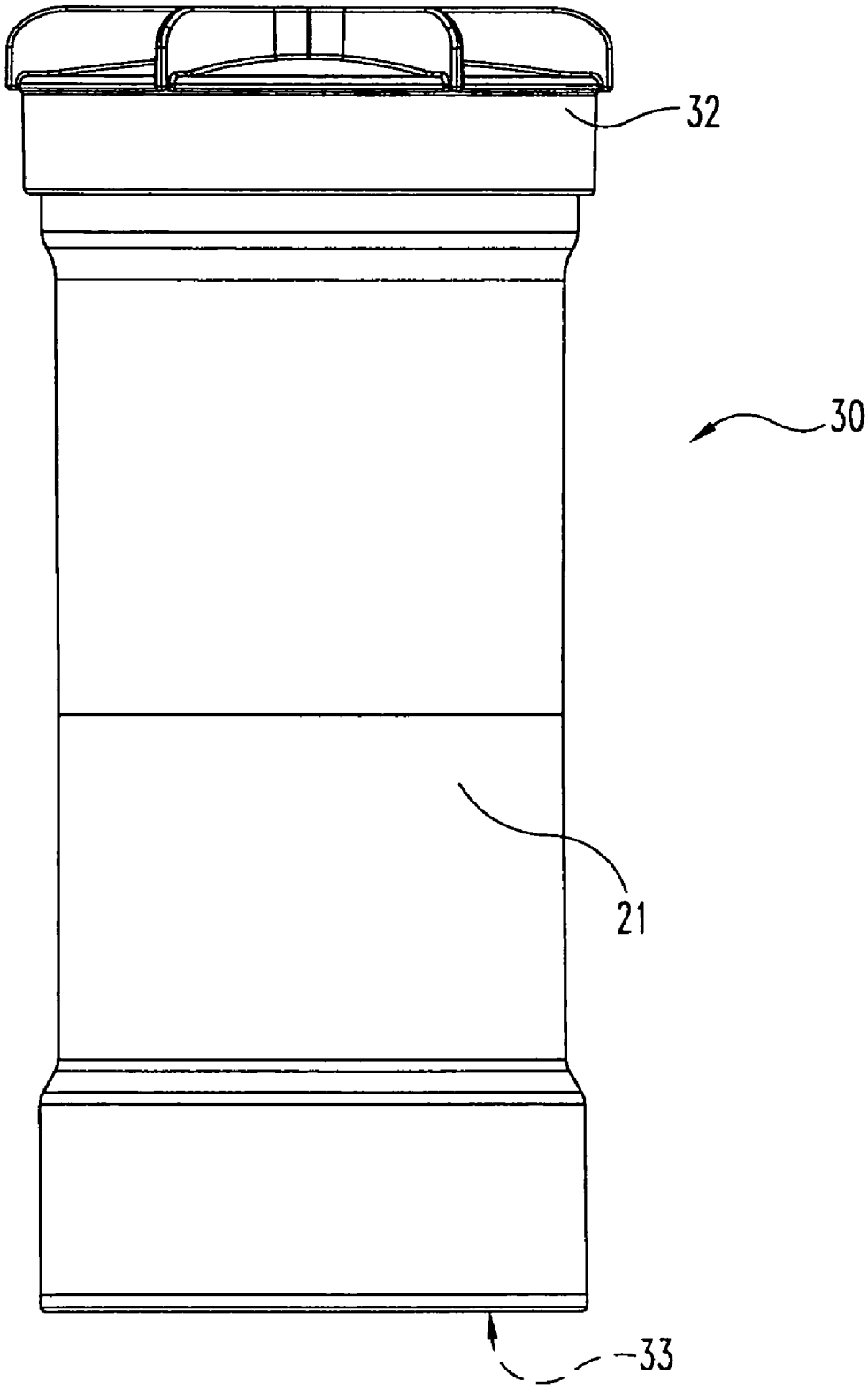
FIG. 4 is a front elevational view of a filtration centrifuge according to another embodiment of the present invention.
Figure 5:
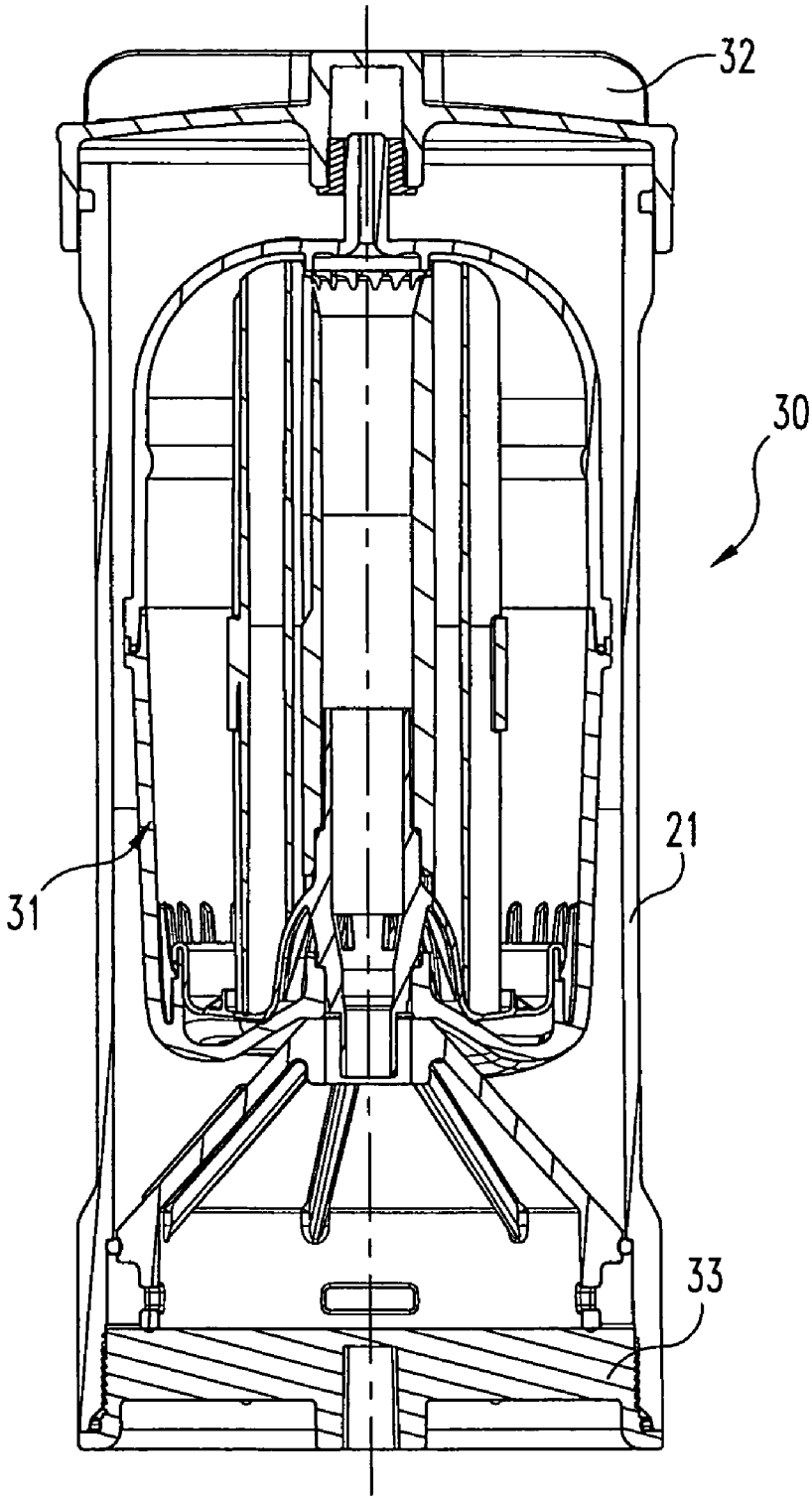
FIG. 5 is a front elevational view, in full section, of the FIG. 4 filtration centrifuge
Figure 6:
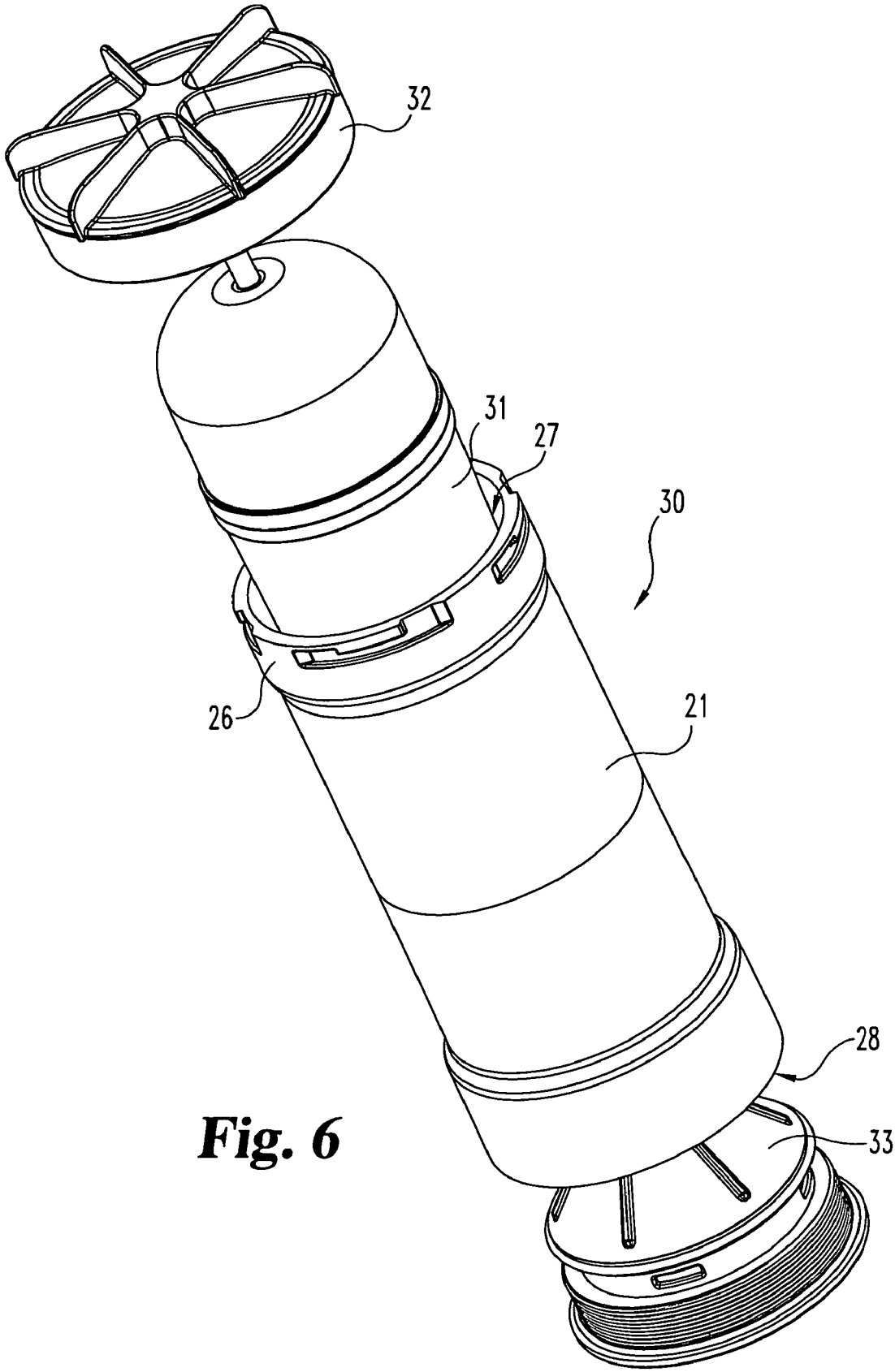
FIG. 6 is an exploded view of the FIG. 4 filtration centrifuge.
Figure 7:
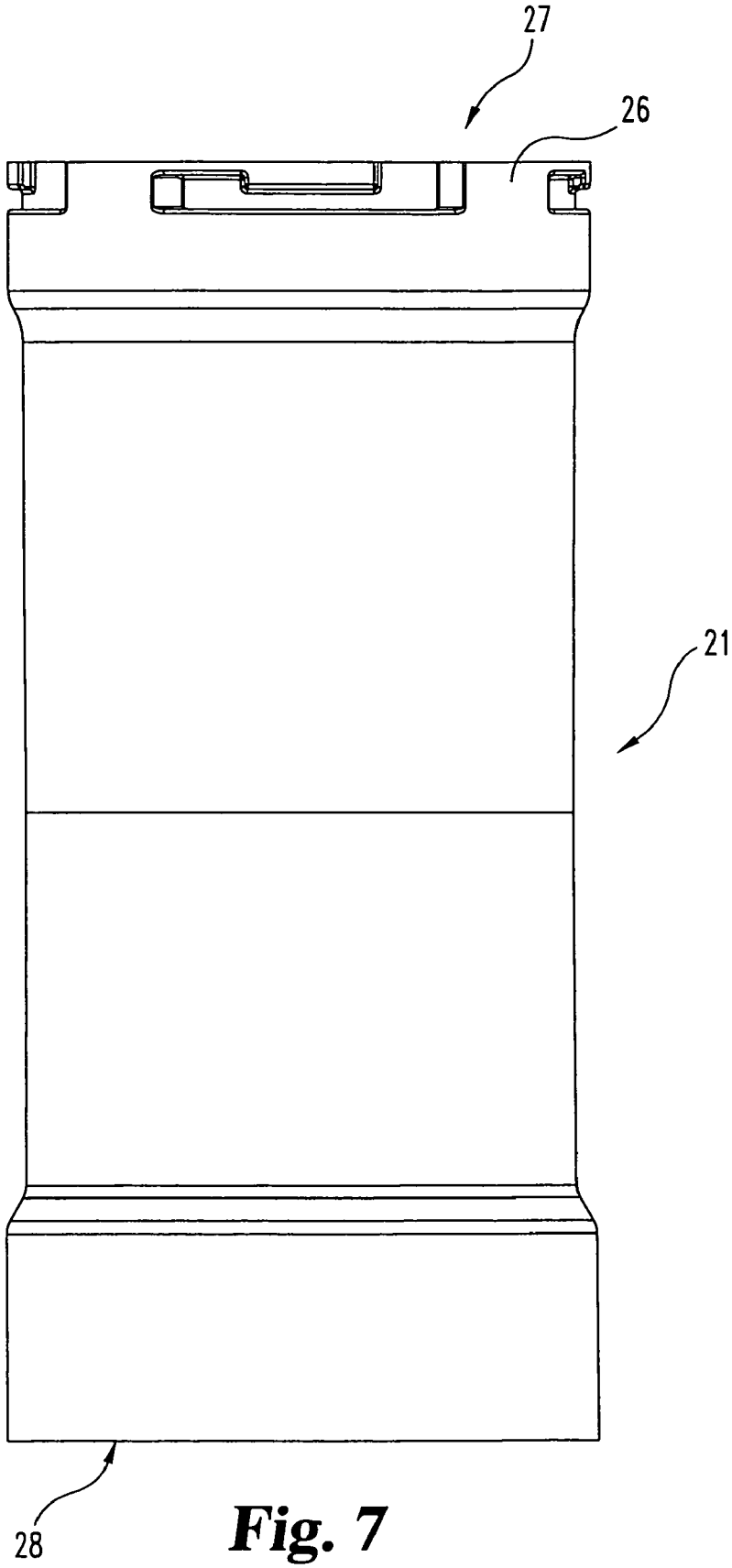
FIG. 7 is a front elevational view of a canister comprising one component of the FIG. 1 and FIG. 4 filtration centrifuges.
Figure 8:
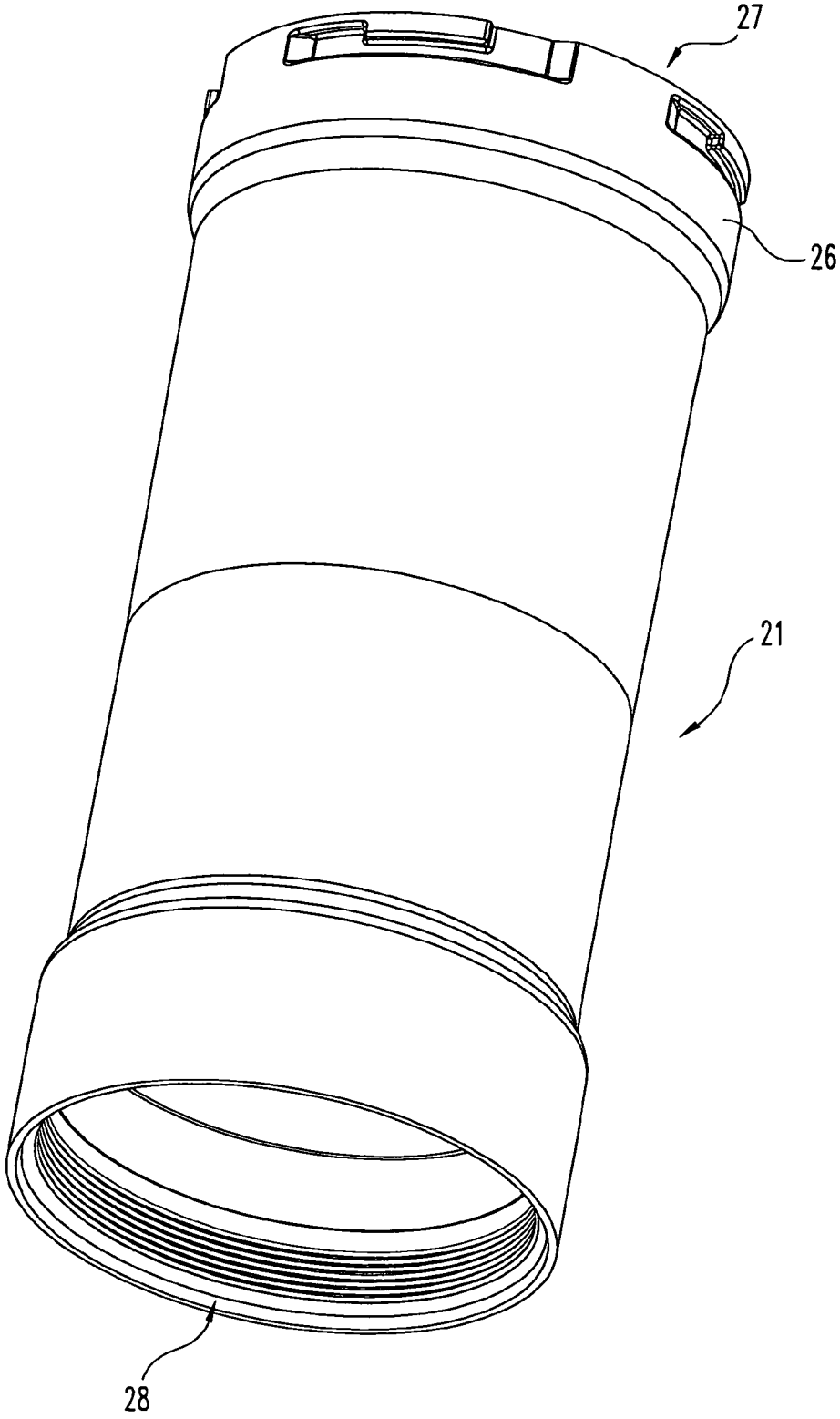
FIG. 8 is a perspective view of the FIG. 7 canister.
Figure 9:
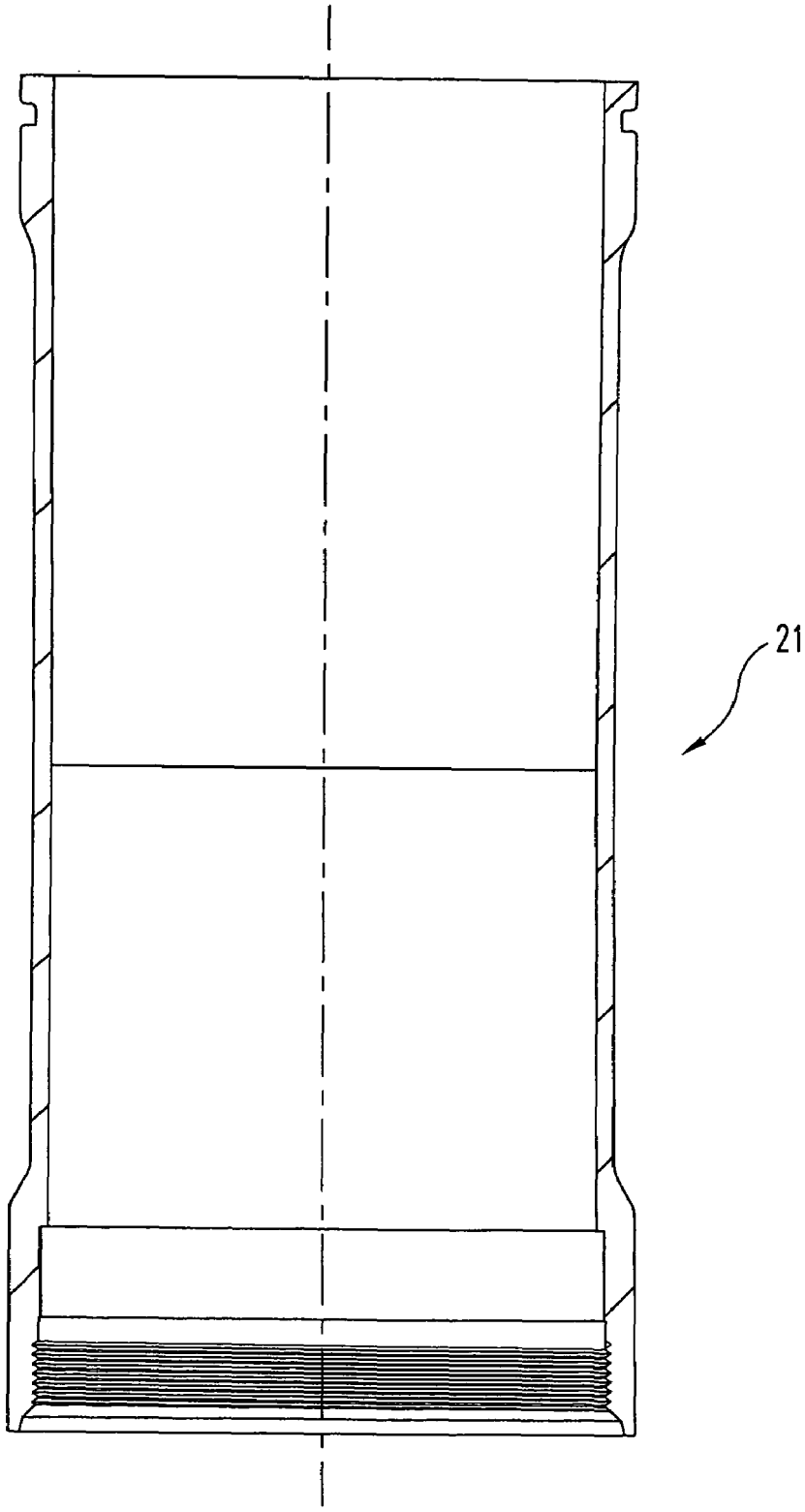
FIG. 9 is a front elevational view, in full section, of the FIG. 7 canister.
Figure 10:
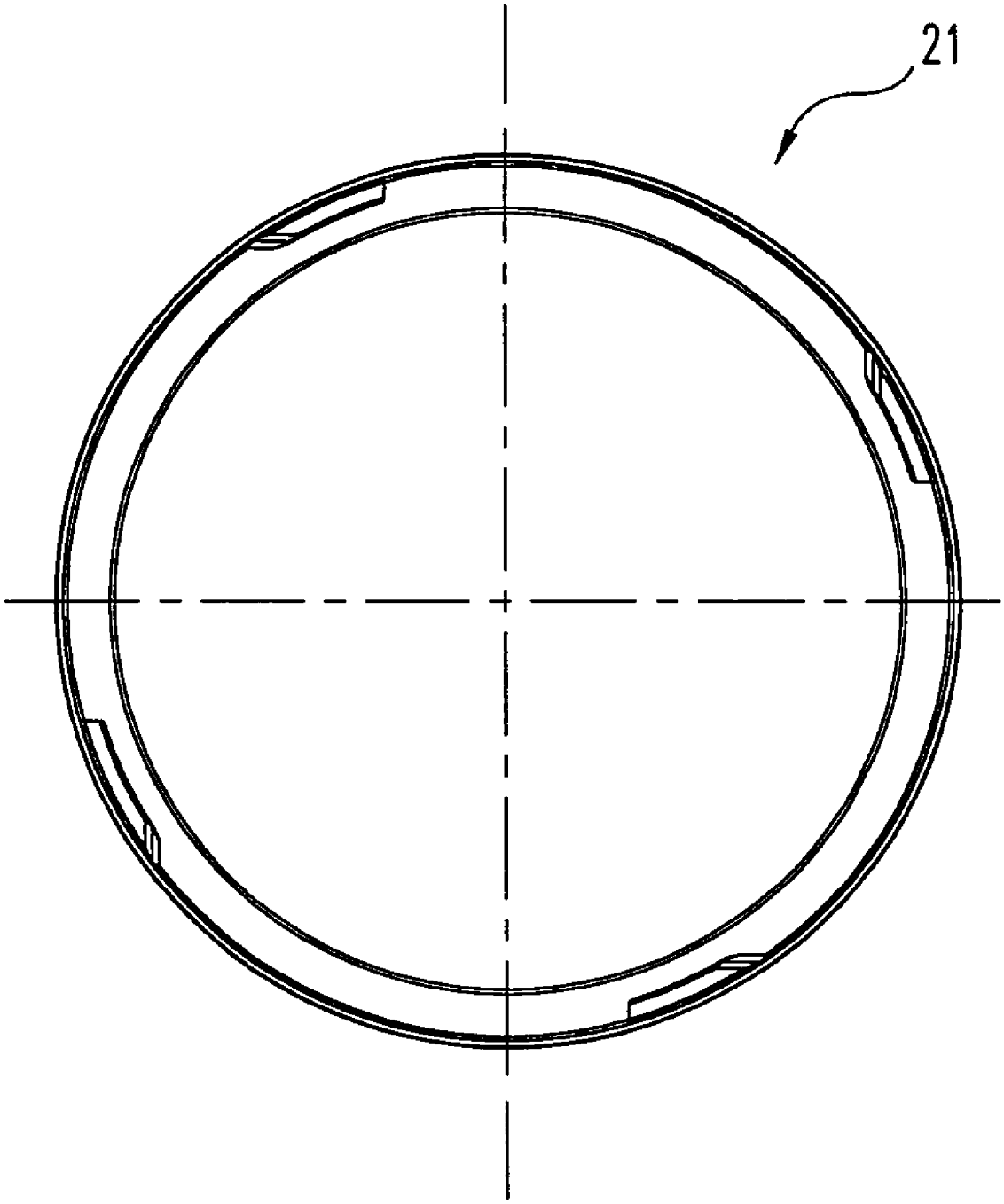
FIG. 10 is a top plan view of the FIG. 7 canister.
Figure 11:
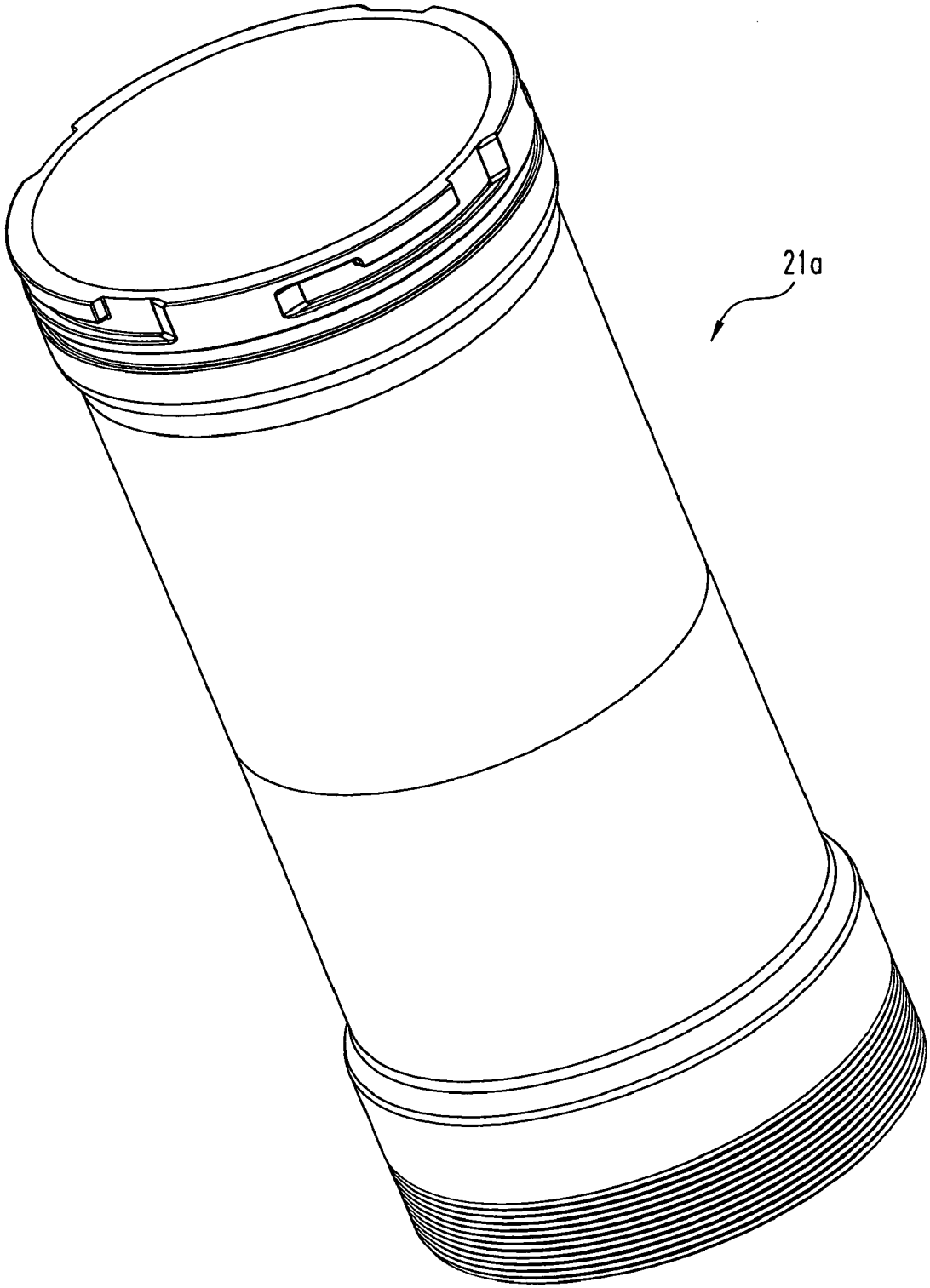
FIG. 11 is a perspective view of an alternative canister construction that is suitable for use as part of the FIG. 1 and FIG. 4 filtration centrifuges.
Figure 12:
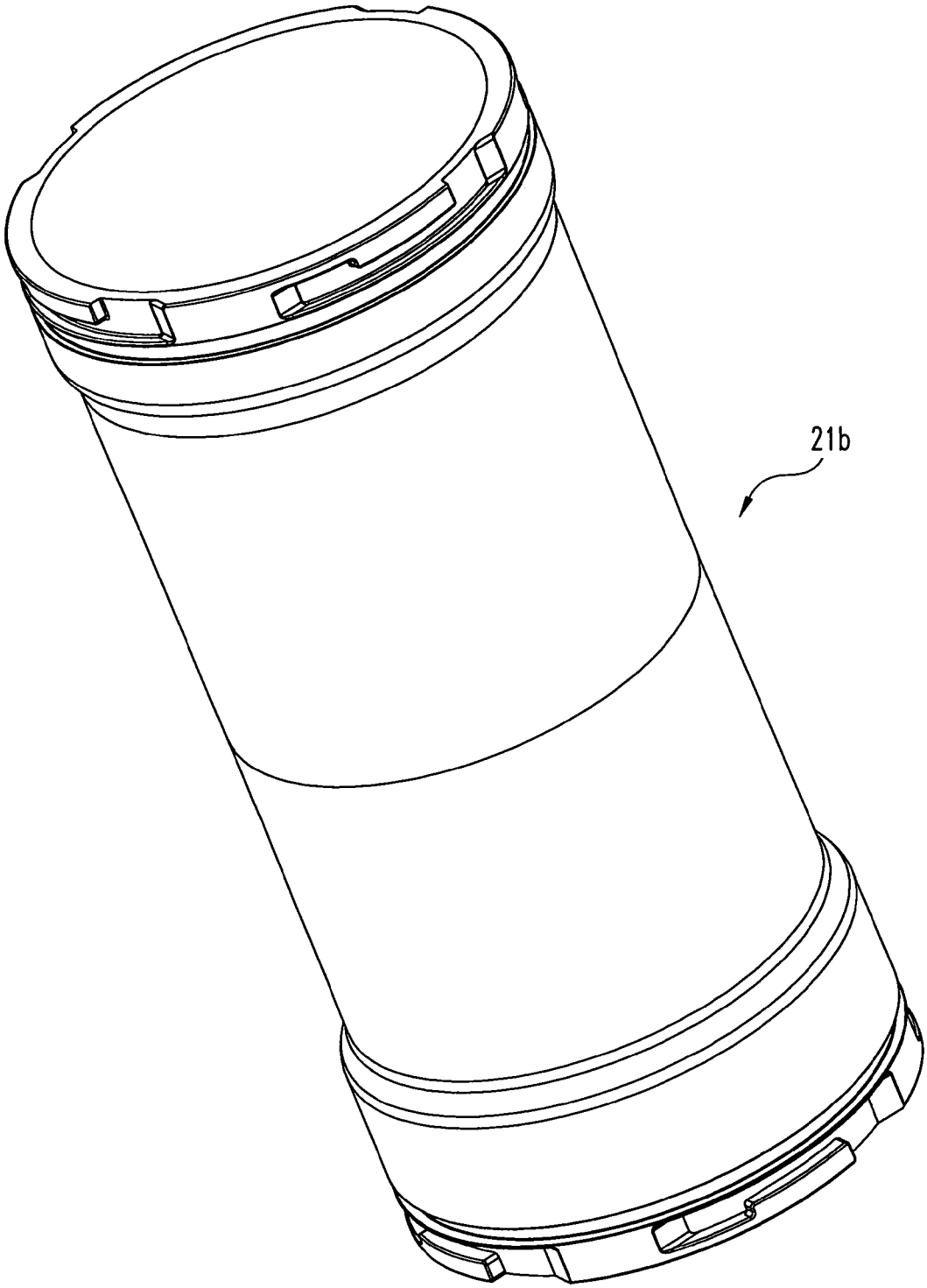
FIG. 12 is a perspective view of another alternative canister construction that is suitable for use as part of the FIG. 1 and FIG. 4 filtration centrifuges.
Figure 13:
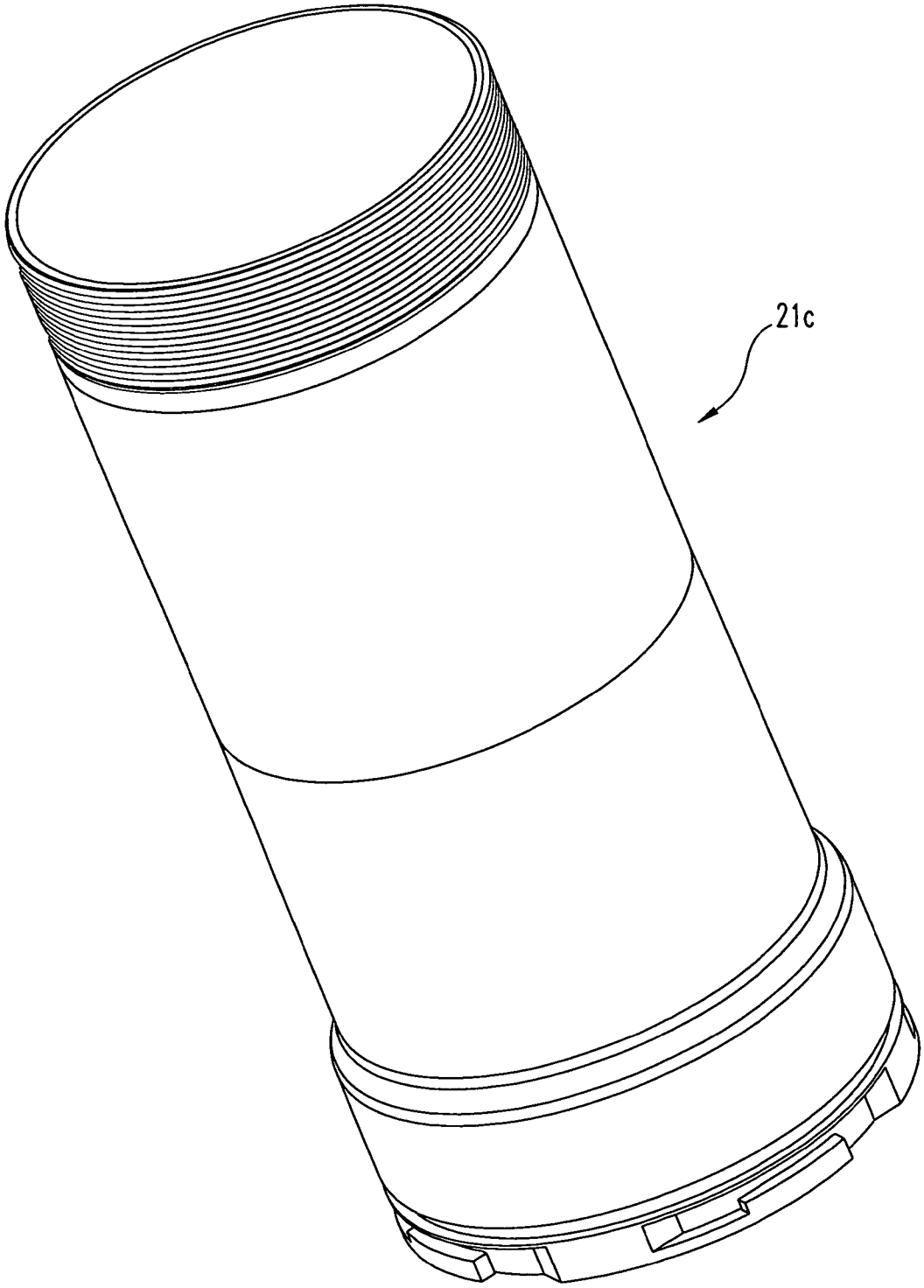
FIG. 13 is a perspective view of another alternative canister construction that is suitable for use as part of the FIG. 1 and FIG. 4 filtration centrifuges.
Figure 14:
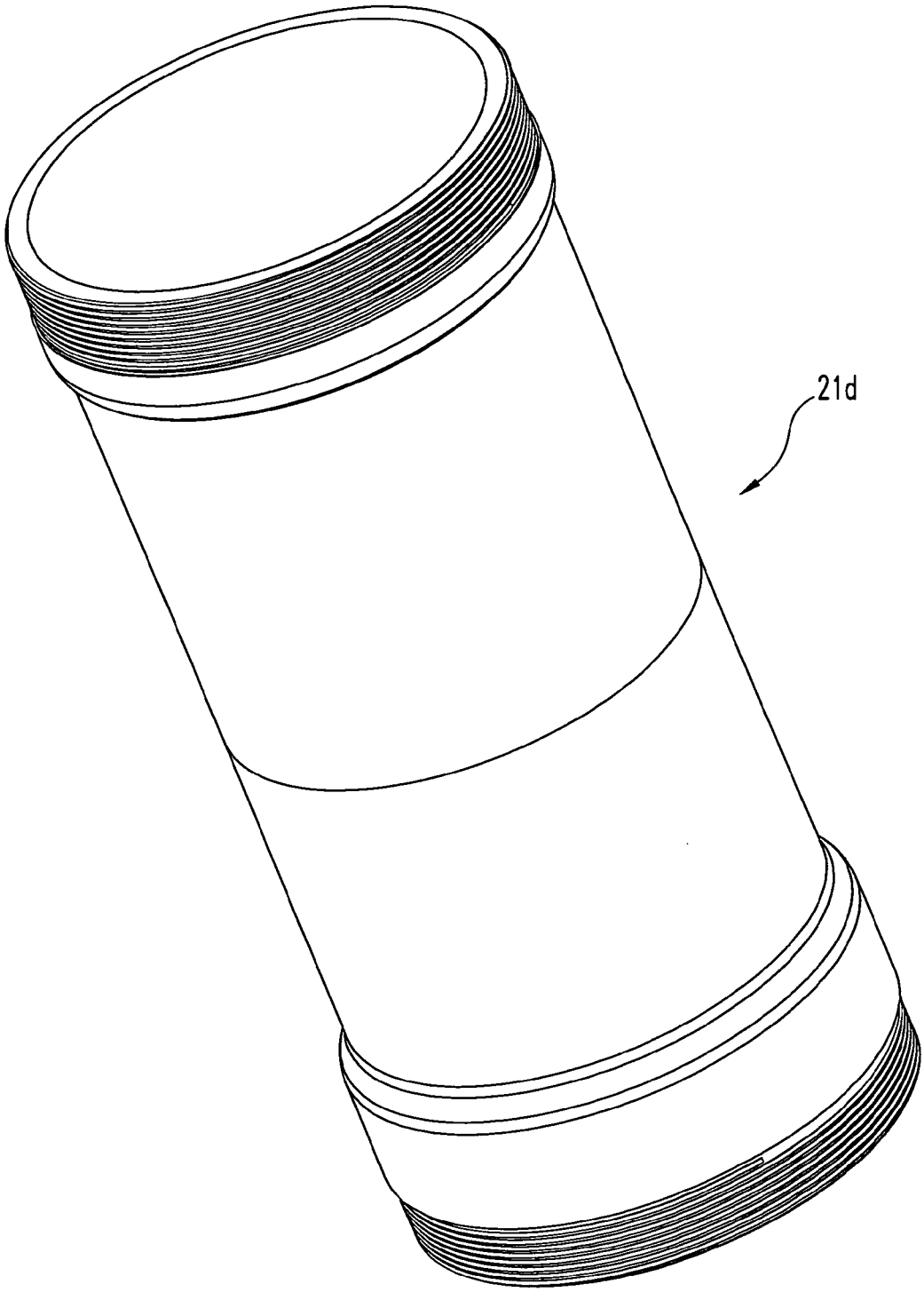
FIG. 14 is a perspective view of another alternative canister construction that is suitable for use as part of the FIG. 1 and FIG. 4 filtration centrifuges.
Figure 15:
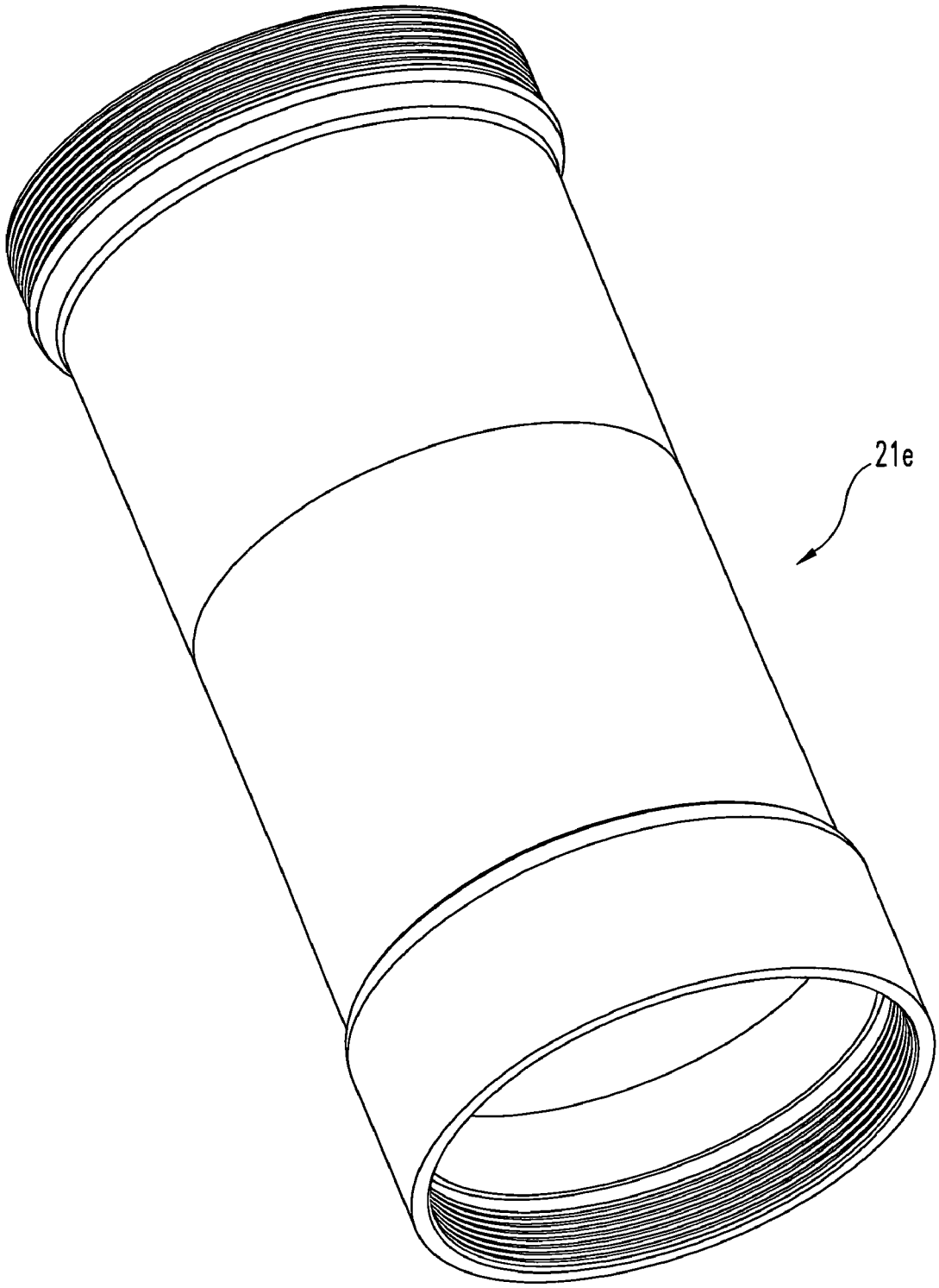
FIG. 15 is a perspective view of another alternative canister construction that is suitable for use as part of the FIG. 1 and FIG. 4 filtration centrifuges.
Figure 16:
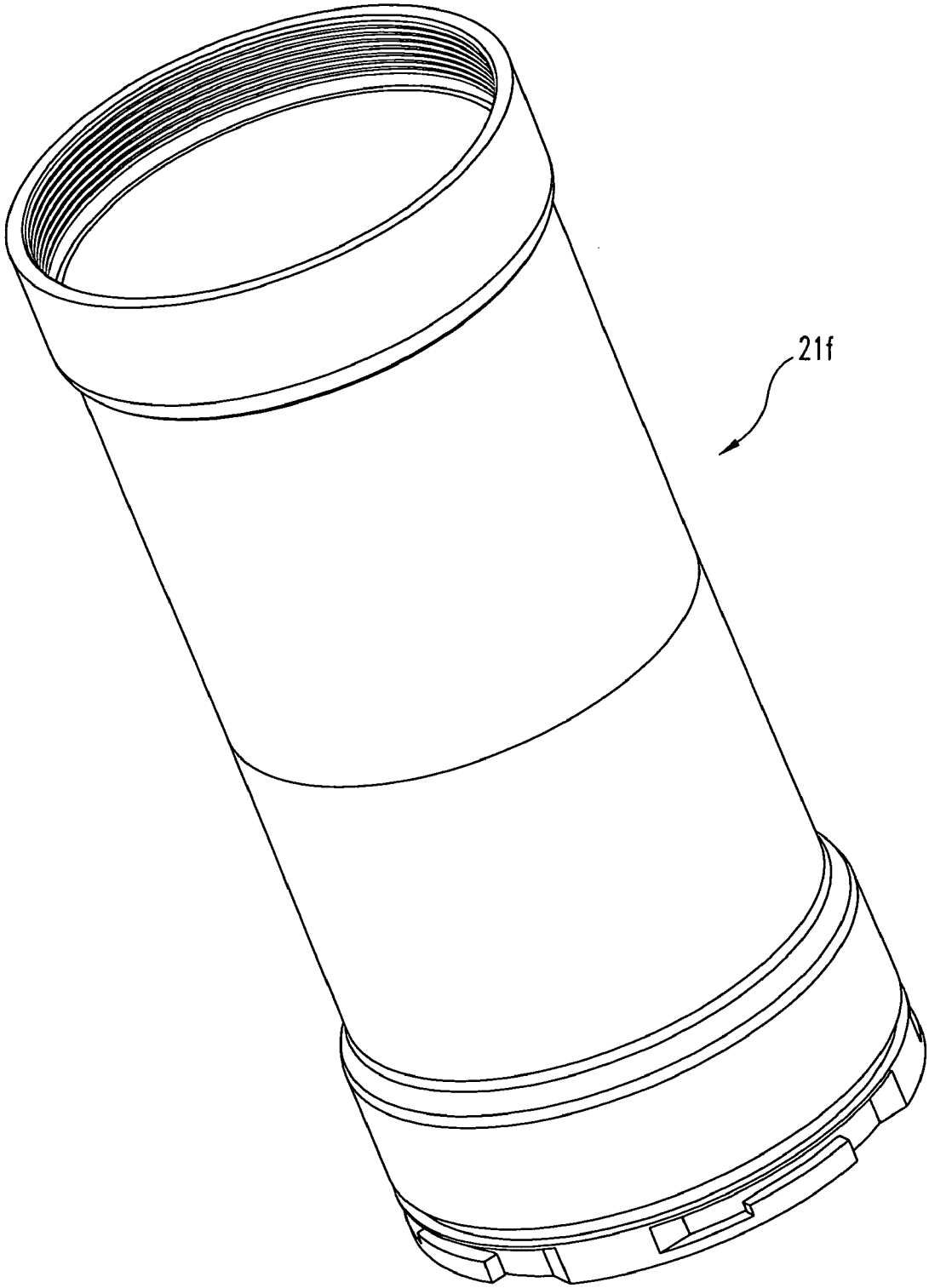
FIG. 16 is a perspective view of another alternative canister construction that is suitable for use as part of the FIG. 1 and FIG. 4 filtration centrifuges.
Figure 17:
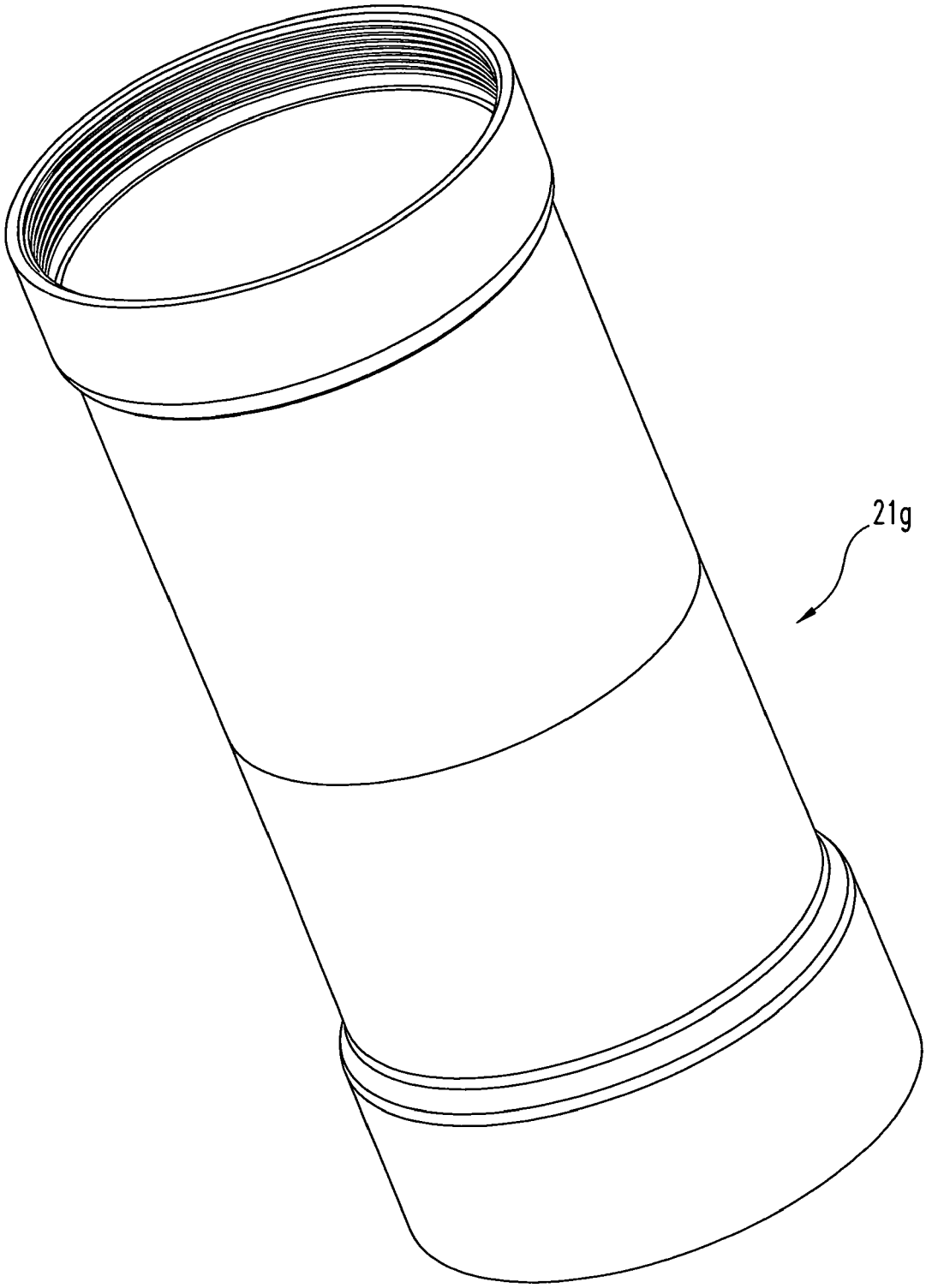
FIG. 17 is a perspective view of another alternative canister construction that is suitable for use as part of the FIG. 1 and FIG. 4 filtration centrifuges.
Figure 18:
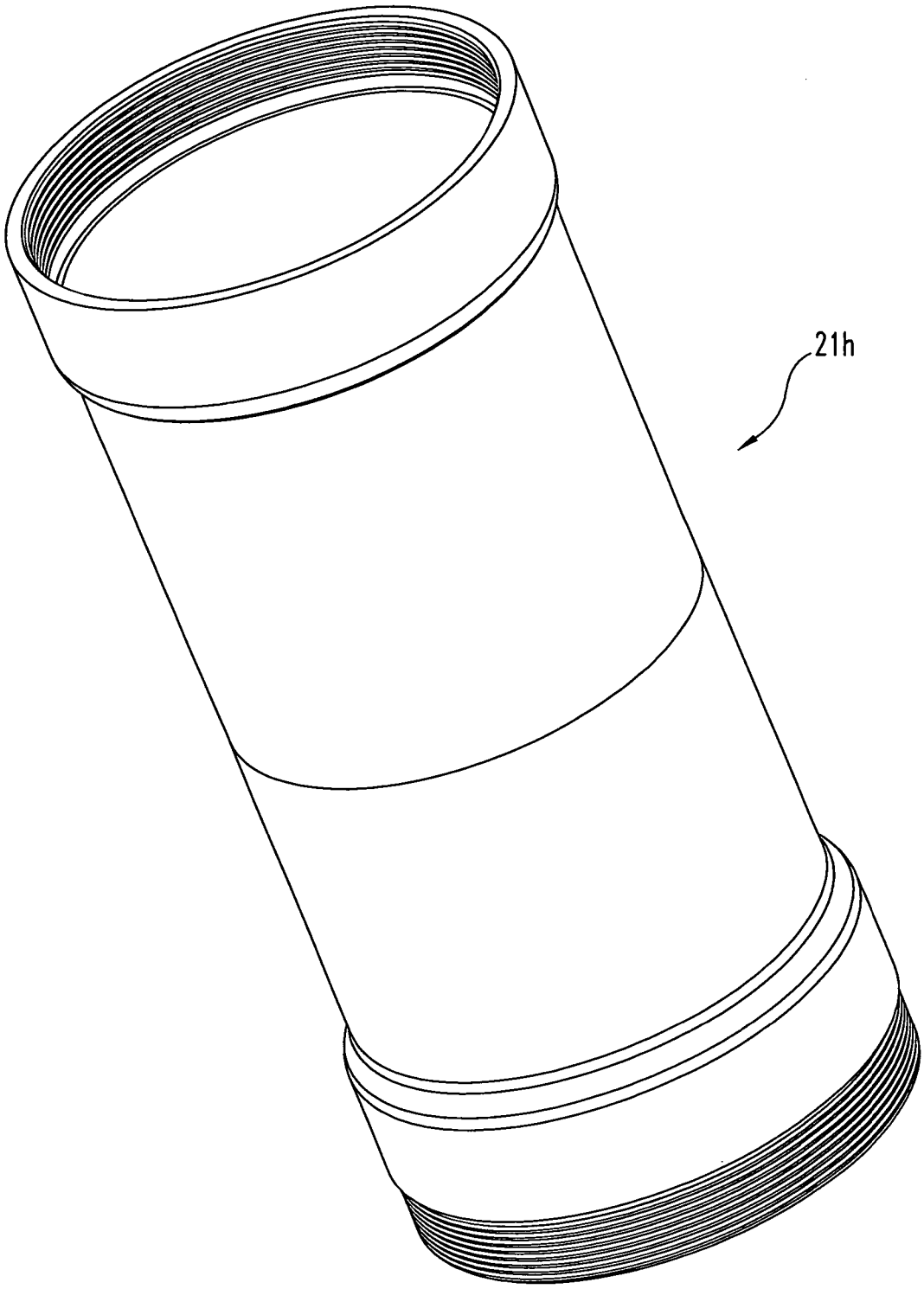
FIG. 18 is a perspective view of another alternative canister construction that is suitable for use as part of the FIG. 1 and FIG. 4 filtration centrifuges.

The filtration centrifuge embodiment of FIGS. 1-3 includes a rotor shaft 23 and FIG. 2 illustrates how the rotor shaft 23 cooperates with the rotor assembly 22 and the design of the top and bottom caps 24 and 25, respectively. In the alternative filtration centrifuge 30 embodiment of FIGS. 4, 5, and 6, there is no rotor shaft that is used (shaftless) and the rotor assembly 31 and the top and bottom caps 32 and 33, respectively, are designed accordingly, see FIG. 5. The centrifuge rotor can be configured as a permanent cartridge (i.e., take-apart or cleanable rotor) and alternatively as a disposable cartridge in the embodiments of the present invention. These two options for the centrifuge rotor or rotor assembly 22 are each envisioned for both the shaft design of FIGS. 1-3 and for the shaftless design of FIGS. 4-6. These figures only show the disposable cartridge option.

While the nine different end configurations for the canister include "internal-internal", "external-external", and "bayonet-bayonet", the preferred canister construction is to vary the end styles so that it is easier to recall the proper vertical orientation for the canister caps by noting that the particular end style configuration on the open upper end and the particular end style configuration on the open lower end of the canister. It is also understood that the top and/or bottom cap(s) can be fastened to the canister by means of mechanical fasteners, though these options have not been shown in the figures.

The fact that the canister 21 of the present invention is open at both ends permits service from either end of the filtration centrifuge 20. The top and bottom caps, such as caps 24 and 25, seal closed the open ends of the corresponding canister. Oil is supplied to the rotor assembly by an oil inlet into the canister and, from there, through one or more openings 35 defined by the bottom cap 25. The opening(s) 35 in the bottom cap 25 communicates with the interior of the rotor assembly 22. A drain opening is provided adjacent to the bottom of the filtration cartridge (see FIG. 19).

A similar set of design options is available for top cap 24, including the sealing capability and the provision for an oil inlet location. The sealing by the bottom cap 25 includes a seal 37 positioned below the threads and a second seal 38 positioned above the oil passageway that leads to the interior of the bottom cap and, from there, into the rotor assembly 22.

Figure 19:
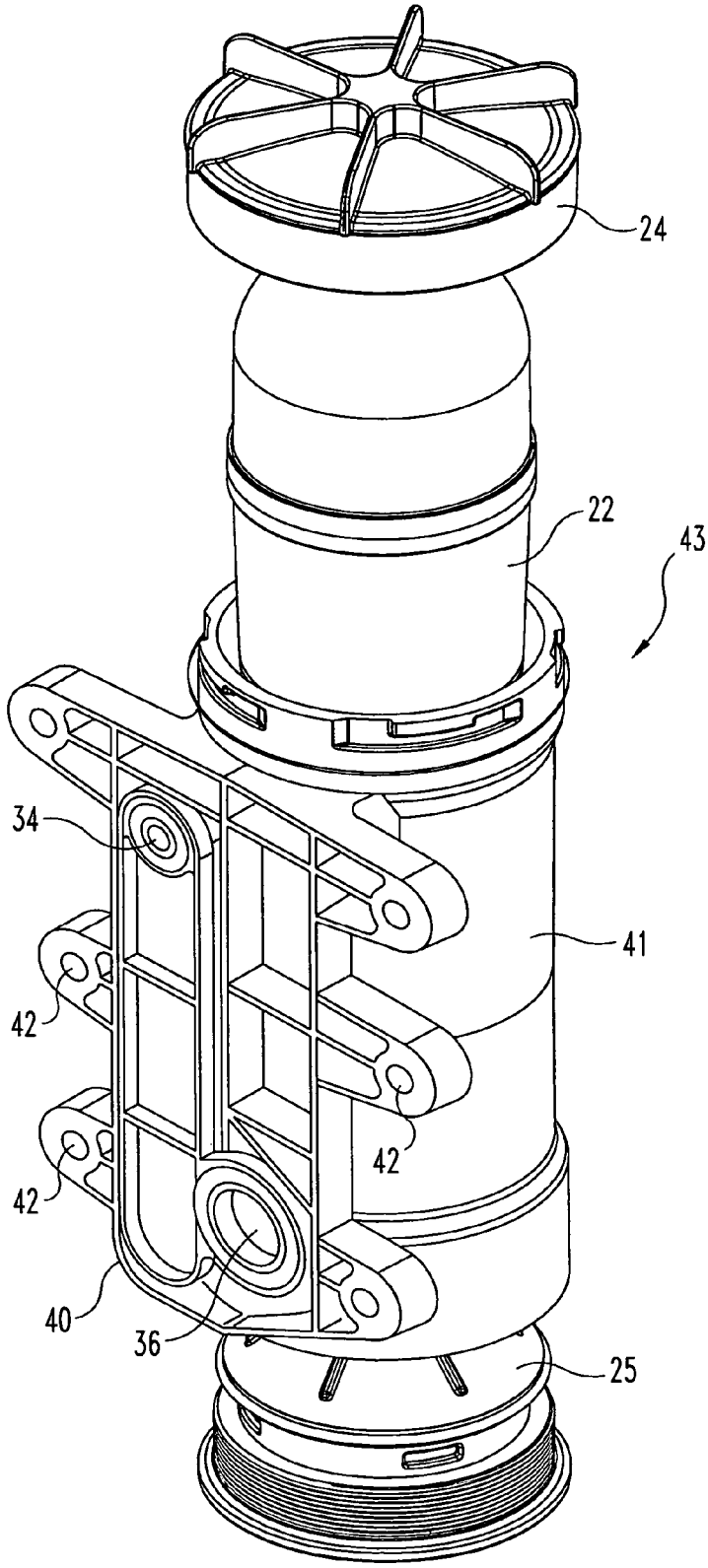
FIG. 19 is an exploded view of a filtration centrifuge according to the present invention incorporating an integral mounting back plate.
Figure 20:
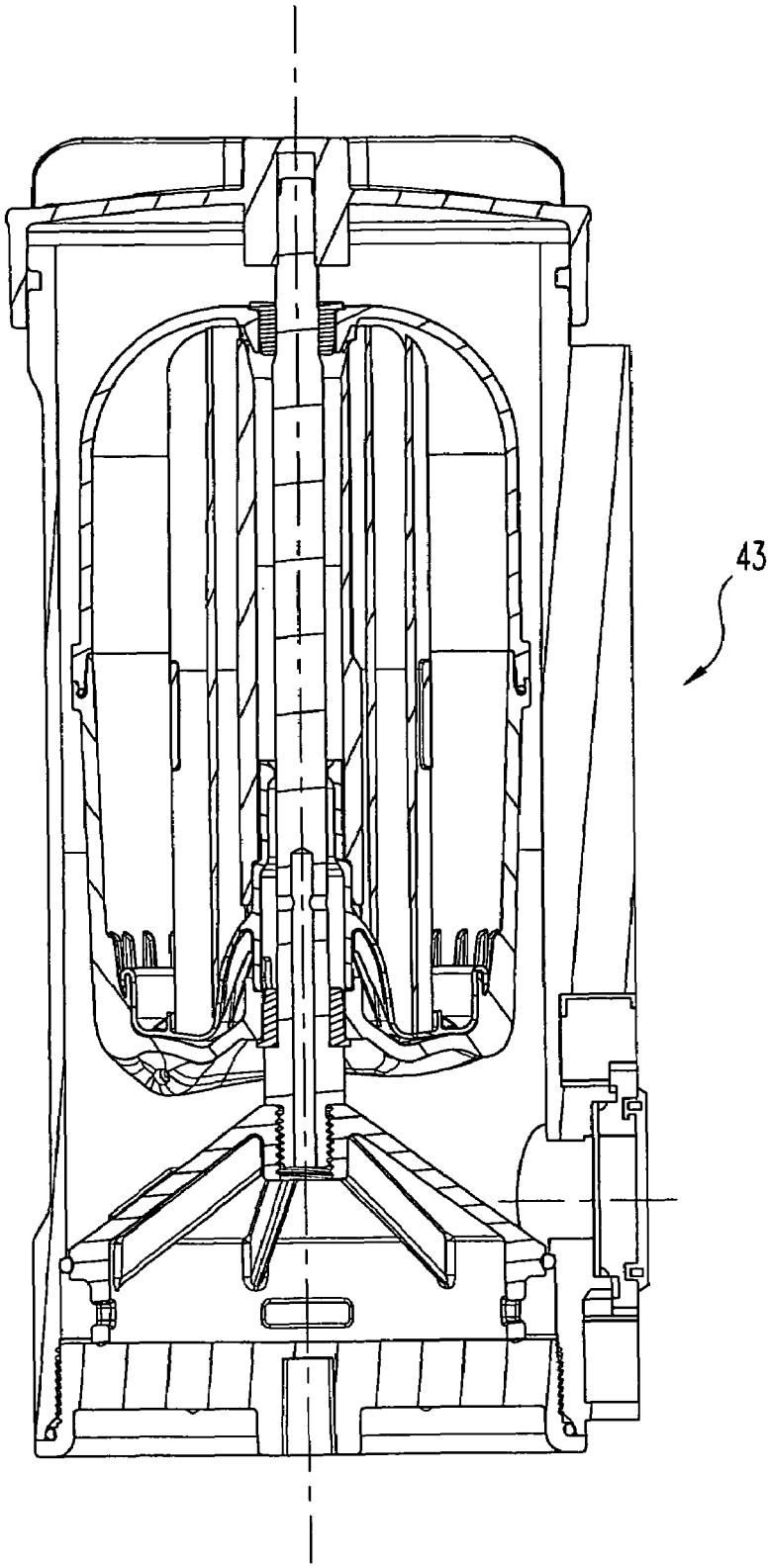
FIG. 20 is a side elevational view, in full section, of the FIG. 19 filtration centrifuge.

Depending on the specific application and the platform specifics of where the filtration cartridge 20 is installed, a mounting bracket or back plate can be used according to the present invention. A suitable mounting back plate 40 is illustrated in FIGS. 19 and 20. This back plate 40 is integrally joined to the outer wall of the canister 41 by either unitarily molding the back plate 40 with the canister 41 or by the use of sonic/vibration welding, by use of chemical bonding means, or by use of mechanical fasteners to connect these two separate components. As illustrated in FIG. 19, there are six (6) mounting holes 42 defined by back plate 40 for attaching the filtration centrifuge 43 to an engine or a remote mount location. As illustrated in FIG. 19, back plate 40 provides an oil inlet 34 and drain opening 36. It will also be noted that the specific mounting hole pattern can be varied depending on the specific application and location.

As another aspect of the present invention, the canister may be shortened or lengthened depending on the particular application. For example, in the case of a tight removal height situation, the canister may be shortened and the top cap lengthened to reduce the overall height that is required in order to lift or replace the centrifuge rotor assembly. The same is true for the bottom cap/canister scenario or any required length or height changes to the caps or canisters to accommodate the customer requirement or aftermarket need.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A filtration centrifuge comprising a housing canister having a sidewall that defines a first open end, a second open end, and a hollow interior;

a rotor assembly supported within said hollow interior and being constructed and arranged for rotary motion relative to said housing canister for processing a flow of fluid delivered to said rotor assembly;

a first cap constructed and arranged to removably assemble to said housing canister to close off said first open end, removal of said first cap from said housing canister restoring said first open end to an open condition; and a second cap constructed and arranged to removably assemble to said housing canister to close off said second open end, removal of said second cap from said housing canister restoring said second open end to an open condition, one of said first and second caps defining a flow passageway for said flow of fluid, wherein said rotor assembly is accessible from said first open end and is accessible from said second open end, wherein said first open end is constructed and arranged with a bayonet connection and said first cap is constructed and arranged with a cooperating assembly structure such that the first cap assembles to said first open end with an insert-then turn motion.

2. The filtration centrifuge of claim 1 wherein said second open end is constructed and arranged with an externally-threaded connection and said second cap is constructed and arranged with a cooperating assembly structure such that said second cap assembles to said second open end by threaded engagement.

3. The filtration centrifuge of claim 1 wherein said second open end is constructed and arranged with an internally-threaded connection and said second cap is constructed and arranged with a cooperating assembly structure such that said second cap assembles to said second open end by threaded engagement.

4. The filtration centrifuge of claim 1 wherein said second open end is constructed and arranged with a bayonet connection and said second cap is constructed and arranged with a cooperating assembly structure such that said second cap assembles to said second open end with an insert-then turn motion.

5. The filtration centrifuge of claim 1 which further includes a rotor shaft constructed and arranged for supporting said rotor assembly relative to said housing canister.

6. The filtration centrifuge of claim 1 which further includes a mounting back plate integrally joined to said housing canister.

7. The filtration centrifuge of claim 6 wherein said mounting back plate defines a plurality of mounting holes.

8. The filtration centrifuge of claim 7 wherein said mounting back plate further defines a fluid inlet and a drain opening.

9. A filtration centrifuge comprising a housing canister having a sidewall that defines a first open end, a second open end, and a hollow interior;

a rotor assembly supported within said hollow interior and being constructed and arranged for rotary motion relative to said housing canister for processing a flow of fluid delivered to said rotor assembly;

a first cap constructed and arranged to removably assemble to said housing canister to close off said first open end, removal of said first cap from said housing canister restoring said first open end to an open condition; and a second cap constructed and arranged to removably assemble to said housing canister to close off said second open end, removal of said second cap from said housing canister restoring said second open end to an open condition, one of said first and second caps defining a flow passageway for said flow of fluid, wherein said rotor assembly is accessible from said first open end and is accessible from said second open end, wherein said first open end is constructed and arranged with an externally-threaded connection and said first cap is constructed and arranged with a cooperating assembly structure such that the first cap assembles to said first open end by threaded engagement.

10. The filtration centrifuge of claim 9 wherein said second open end is constructed and arranged with a bayonet connection and said second cap is constructed and arranged with a cooperating assembly structure such that said second cap assembles to said second open end with an insert-then turn motion.

11. The filtration centrifuge of claim 9 wherein said second open end is constructed and arranged with an internally-threaded connection and said second cap is constructed and arranged with a cooperating assembly structure such that said second cap assembles to said second open end by threaded engagement.

12. The filtration centrifuge of claim 9 wherein said second open end is constructed and arranged with an externally-threaded connection and said second cap is constructed and arranged with a cooperating assembly structure such that said second cap assembles to said second open end by threaded engagement.

13. The filtration centrifuge of claim 9 which further includes a rotor shaft constructed and arranged for supporting said rotor assembly relative to said housing canister.

14. The filtration centrifuge of claim 9 which further includes a mounting back plate integrally joined to said housing canister, wherein said mounting back plate defines a plurality of mounting holes, a fluid inlet and a drain opening.

15. A filtration centrifuge comprising a housing canister having a sidewall that defines a first open end, a second open end, and a hollow interior;

a rotor assembly supported within said hollow interior and being constructed and arranged for rotary motion relative to said housing canister for processing a flow of fluid delivered to said rotor assembly;

a first cap constructed and arranged to removably assemble to said housing canister to close off said first open end, removal of said first cap from said housing canister restoring said first open end to an open condition; and a second cap constructed and arranged to removably assemble to said housing canister to close off said second open end, removal of said second cap from said housing canister restoring said second open end to an open condition, one of said first and second caps defining a flow passageway for said flow of fluid, wherein said rotor assembly is accessible from said first open end and is accessible from said second open end, wherein said first open end is constructed and arranged with an internally-threaded connection and said first cap is constructed and arranged with a cooperating assembly structure such that the first cap assembles to said first open end by threaded engagement.

16. The filtration centrifuge of claim 15 wherein said second open end is constructed and arranged with an externally-threaded connection and said second cap is constructed and arranged with a cooperating assembly structure such that said second cap assembles to said second open end by threaded engagement.

17. The filtration centrifuge of claim 15 wherein said second open end is constructed and arranged with a bayonet connection and said second cap is constructed and arranged with a cooperating assembly structure such that said second cap assembles to said second open end with an insert-then turn motion.

18. The filtration centrifuge of claim 15 wherein said second open end is constructed and arranged with an internally-threaded connection and said second cap is constructed and arranged with a cooperating assembly structure such that said second cap assembles to said second open end by threaded engagement.

19. The filtration centrifuge of claim 15 which further includes a rotor shaft constructed and arranged for supporting said rotor assembly relative to said housing canister.

20. The filtration centrifuge of claim 15 which further includes a mounting back plate integrally joined to said housing canister, wherein said mounting back plate defines a plurality of mounting holes, a fluid inlet and a drain opening.

21. A filtration centrifuge comprising a housing canister having a sidewall that defines a first open end, a second open end, and a hollow interior;

a rotor assembly supported within said hollow interior and being constructed and arranged for rotary motion relative to said housing canister for processing a flow of fluid delivered to said rotor assembly;

a first cap constructed and arranged to removably assemble to said housing canister to close off said first open end, removal of said first cap from said housing canister restoring said first open end to an open condition;

a second cap constructed and arranged to removably assemble to said housing canister to close off said second open end, removal of said second cap from said housing canister restoring said second open end to an open condition, one of said first and second caps defining a flow passageway for said flow of fluid, wherein said rotor assembly is accessible from said first open end and is accessible from said second open end; and a mounting back plate integrally joined to said housing canister, wherein said mounting back plate defines a plurality of mounting holes, a fluid inlet and a drain opening.

* * * * *